US010362812B2

(12) United States Patent
Yue

(10) Patent No.: US 10,362,812 B2
(45) Date of Patent: Jul. 30, 2019

(54) FABRIC DEVICE

(71) Applicant: Steven Yue, Taipei (TW)

(72) Inventor: Steven Yue, Taipei (TW)

( * ) Notice: Subject to any disclaimer, the term of this patent is extended or adjusted under 35 U.S.C. 154(b) by 0 days.

(21) Appl. No.: 15/661,905

(22) Filed: Jul. 27, 2017

(65) Prior Publication Data

US 2018/0295894 A1 Oct. 18, 2018

(30) Foreign Application Priority Data

Apr. 14, 2017 (TW) ..... 106112491 A

(51) Int. Cl.

| | |
|---|---|
| ***A41D 1/00*** | (2018.01) |
| ***A41D 13/00*** | (2006.01) |
| ***H05B 3/34*** | (2006.01) |
| ***A41D 13/005*** | (2006.01) |
| ***A41D 13/01*** | (2006.01) |
| ***A41D 13/12*** | (2006.01) |
| ***F21S 9/02*** | (2006.01) |

(Continued)

(52) U.S. Cl.

CPC ..... *A41D 1/002* (2013.01); *A41D 1/005* (2013.01); *A41D 13/0051* (2013.01); *A41D 13/01* (2013.01); *A41D 13/1281* (2013.01); *F21S 9/02* (2013.01); *F21V 23/04* (2013.01); *F21V 33/0008* (2013.01); *H05B 3/342* (2013.01); *H05B 33/0827* (2013.01); *H05B 33/0842* (2013.01); *F21Y 2115/10* (2016.08); *G08B 5/36* (2013.01)

(58) Field of Classification Search

CPC ..... H05B 33/08; H05B 33/0827; H05B 33/0842; H05B 3/34; H05B 3/342; H05B 1/00; H05B 1/02; H05B 2203/036; H05B 2203/01; A41D 1/00; A41D 1/002; A41D 1/04; A41D 13/00; A41D 13/005; A41D 13/0051

See application file for complete search history.

(56) References Cited

U.S. PATENT DOCUMENTS

| | | | | |
|---|---|---|---|---|
| 3,729,613 A * | 4/1973 | Deloire | ..... | A41D 13/0051 219/211 |
| 2005/0223464 A1* | 10/2005 | Huang | ..... | A41D 13/01 2/102 |
| 2008/0116189 A1* | 5/2008 | Fernandez | ..... | A41D 13/0051 219/211 |

FOREIGN PATENT DOCUMENTS

| | | |
|---|---|---|
| CN | 205922985 U | 2/2017 |
| TW | M489484 U | 11/2014 |

(Continued)

OTHER PUBLICATIONS

The Search Report issued to European counterpart application No. 17183396.5 by the EPO dated Mar. 2, 2018.

(Continued)

*Primary Examiner* — Thai Pham

(74) *Attorney, Agent, or Firm* — Hamre, Schumann, Mueller & Larson, P.C.

(57) ABSTRACT

A fabric device includes a fabric and an electronic module. The fabric includes a fabric body configured to contact or to be worn on an object, and has a first surface configured to contact the object, and a second surface opposite to the first surface. The fabric body is internally formed with a passage unit which has a plurality of passages intersecting and communicating with each other. The electronic module is disposed in the fabric body and includes a plurality of electronic components, in the form of strips, extending into the passage unit.

7 Claims, 19 Drawing Sheets

(51) Int. Cl.

| | |
|---|---|
| ***F21V 23/04*** | (2006.01) |
| ***F21V 33/00*** | (2006.01) |
| ***H05B 33/08*** | (2006.01) |
| *F21Y 115/10* | (2016.01) |
| *G08B 5/36* | (2006.01) |

(56) References Cited

FOREIGN PATENT DOCUMENTS

| | | | |
|---|---|---|---|
| TW | M546068 | U | 7/2017 |
| WO | 2015101759 | A1 | 7/2015 |

OTHER PUBLICATIONS

Search Report appended to an Office Action issued to Taiwanese counterpart application No. 106112491 by the TIPO dated Apr. 13, 2018.

* cited by examiner

FABRIC DEVICE

CROSS REFERENCE TO RELATED APPLICATION

This application claims priority of Taiwanese Patent Application Number 106112491, filed on Apr. 14, 2017.

FIELD

The disclosure relates to a fabric device, more particularly to a fabric device having a passage unit for insertion of electronic components.

BACKGROUND

A conventional electrically-heated clothes includes a plurality of electric heating wires which can be directly adhered or sewn to a main body of the electrically-heated clothes, or can first be fixed to an electric heating plate, after which the electric heating plate is fixed to the main body of the electrically-heated clothes. However, these fixing methods are not strong, so that the electric heating wires are easily loosened or displaced from the main body of the electrically-heated clothes, especially if the latter is cleaned.

A conventional light emitting clothes is provided in the market for safety or entertainment purposes. The conventional light emitting clothes includes a plurality of light emitting elements fixed to a main body thereof, and a plurality of conductive wires electrically connected to the light emitting elements. The light emitting elements and the conductive wires are usually fixed to the main body of the light emitting clothes using typical fixing methods, such as adhering or stitching. The conventional light emitting clothes similarly has the drawbacks of the aforesaid conventional electrically-heated clothes.

In the medical field, a physiological signal measuring device is often used to monitor the physiological condition of a human body, and includes a plurality of measuring wires each of which has a sensing end. In use, the clothes of a to-be-monitored person must be removed first, after which the measuring wires are placed one by one on the body of the to-be-monitored person at positions to be monitored so as to obtain the required signals.

Use of an electrotherapy device is similar to that of the conventional physiological signal measuring device, that is, the conductive wires of the electrotherapy device are also placed one by one on the specific parts of the user's body for performing electrotherapy on said parts.

SUMMARY

Therefore, an object of the present disclosure is to provide a fabric device having an electronic module stably connected to a fabric thereof.

Another object of this disclosure is to provide a fabric device that can be electrically connected to a medical device.

According to this disclosure, a fabric device comprises a fabric and an electronic module. The fabric includes a fabric body configured to contact or to be worn on an object and having a first surface configured to contact the object, and a second surface opposite to the first surface. The fabric body is internally formed with a passage unit. The passage unit has a plurality of passages intersecting and communicating with each other. The electronic module is disposed in the fabric body and includes a plurality of electronic components, in the form of strips, extending into the passage unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
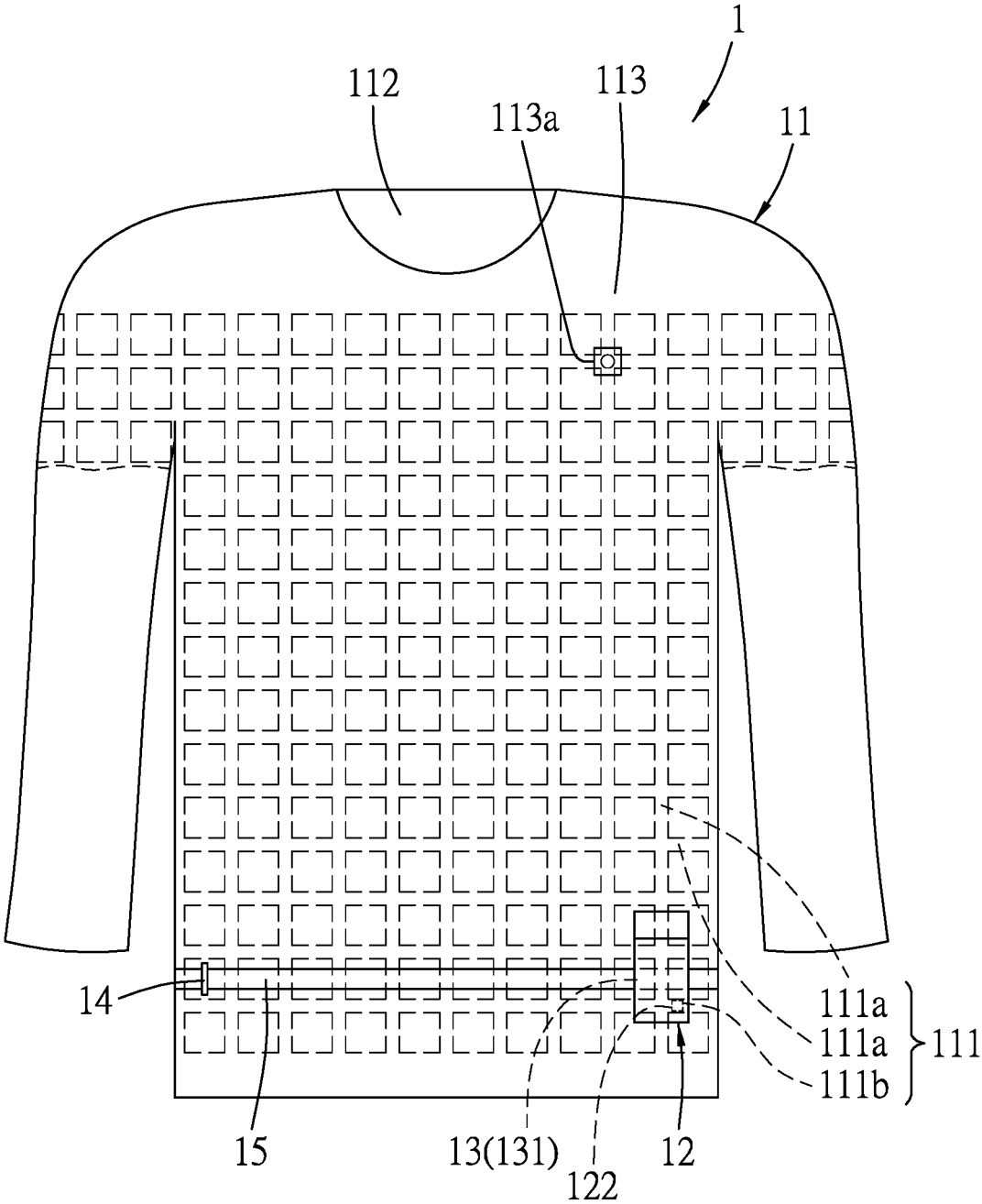
FIG. 1 is a schematic view of a fabric device according to the first embodiment of the present disclosure.

Before the present disclosure is described in greater detail with reference to the accompanying embodiment, it should be noted herein that like elements are denoted by the same reference numerals throughout the disclosure.

Referring to FIGS. 1 to 4, a fabric device according to the first embodiment of the present disclosure is shown to comprise a fabric 1, an electronic module 2, a control unit, and a power supply module 3.

The fabric 1 includes a fabric body 11 configured to contact or to be worn on an object. The object exemplified in this and other embodiments is a human body (not shown). The fabric 1 is made into a blouse or shirt in this embodiment. However, in other embodiments, the fabric 1 may be made into other garments, such as a vest, a hat, a cushion, a blanket, a knee pad, an elbow pad, a shoulder pad, a waist pad, etc., and is not limited thereto. The fabric body 11 has a first or inner surface 112 configured to contact the human body, and a second or outer surface 113 opposite to the first surface 112. The fabric body 11 is internally formed with a passage unit 111. The passage unit 111 has a plurality of passages (111*a*) intersecting and communicating with each other, and an opening (111*b*) formed in the second surface 113 for communicating the passages (111*a*) with an external environment.

The electronic module 2 includes a plurality of electronic components 21, in the form of strips, extending into the passages (111*a*) through the opening (111*b*). In this embodiment, each electronic component 21 is an electric heating wire capable of generating heat when supplied with electric power so as to warm a user's body wearing the fabric 1. The arrangement of the electronic components or electric heating wires 21 in the passage unit 111 may be varied according to the requirement. That is, the number of the electric heating wires 21 can be increased or decreased depending on the body portions of the user that need heating or warming. For example, in this embodiment, the electric heating wires 21 are disposed densely on positions corresponding to chest and back portions of the user for warming said portions.

The control unit is disposed in the fabric body 11 and is electrically connected to the electronic module 2. The control unit is configured to receive an electric power from the power supply module 3 so as to control operation of the electronic module 2. In this embodiment, the outer surface 113 of the fabric body 11 is further formed with a mounting hole (113*a*) communicating with the passages (111*a*). The control unit includes a switch module 22 mounted in the mounting hole 112*a* and exposed from the outer surface 113 of the fabric body 11. The switch module 22 is electrically connected between the power supply module 3 and the electric heating wires 21. The switch module 22 is operable to establish electrical connection between the power supply module 3 and the electric heating wires 21. When the user does not need the fabric device to warm his/her body parts, he/she can turn off the switch module 22 to cut the electrical connection between the electric heating wires 21 and the power supply module 3; and when the user needs the fabric device to warm his/her body parts, he/she can turn on the switch module 22 to establish electrical connection between the electric heating wires 21 and the power supply module 3. Alternatively, the electronic module 2 may not include the switch module 22, and is not limited to what is disclosed herein.

Figure 2:
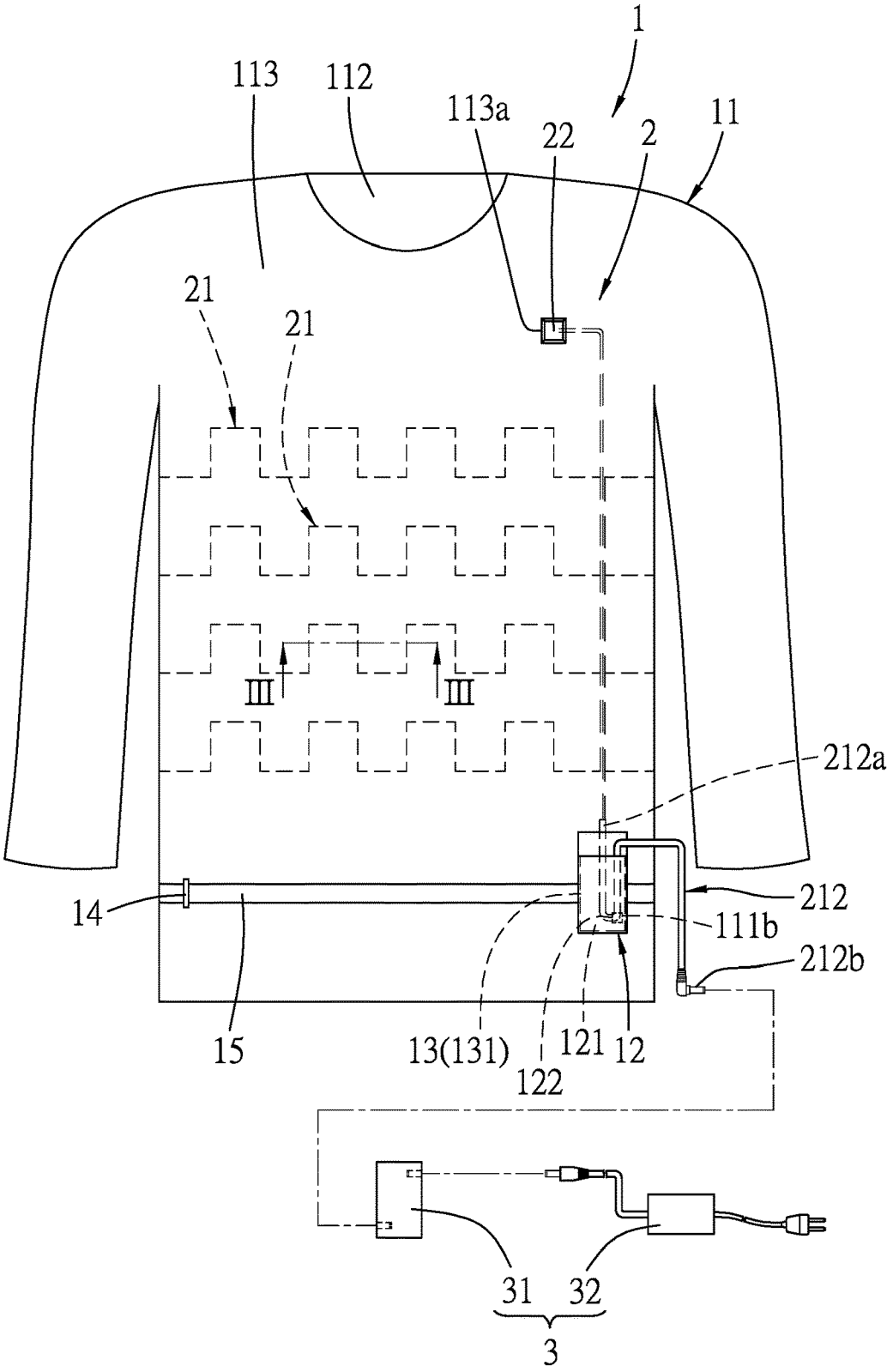
FIG. 2 is another schematic view of the first embodiment.
Figure 3:
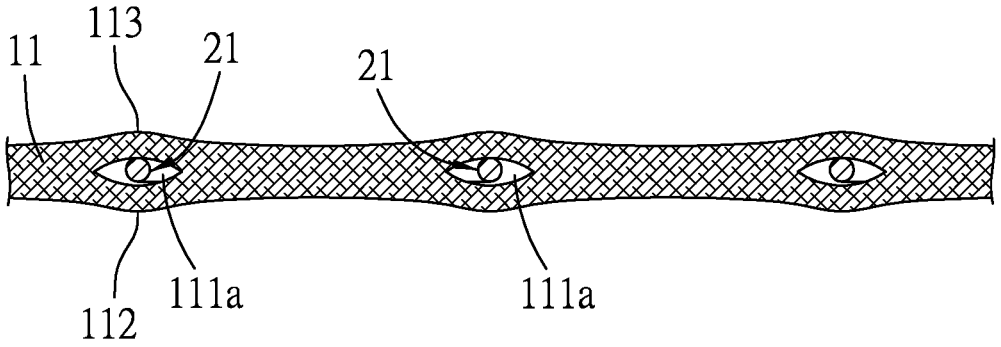
FIG. 3 is a sectional view taken along line III-III of FIG. 2.

With reference to FIG. 2, the power supply module 3 is electrically connected to the control unit. In this embodiment, the power supply module 3 is a rechargeable battery module, and includes a rechargeable battery 31 and a charger 32 for charging the battery 31. The fabric 1 further includes a pouch body 12 connected to and cooperating with the outer surface 113 of the fabric body 11 to define a path 13. The pouch body 12 defines a receiving space 121 for receiving the rechargeable battery 31, and has an aperture 122 that is located between and communicating with the path 13 and the receiving space 121 and that is aligned with the opening (111*b*).

A conductive wire 212 has a first connecting end (212*a*) electrically connected to the switch module 22, and a second connecting end (212*b*) opposite to the first connecting end (212*a*) and extending through the opening (111*b*), the path 13, the aperture 122 and the receiving space 121 and out of the pouch body 12 for connection with the rechargeable battery 31.

The rechargeable battery 31 is connected electrically and detachably to the second connecting end (212*b*) of the conductive wire 212, and provides electric power required for operation of the electric heating wires 21. The charger 32 is connected between the rechargeable battery 31 and a socket of an external power source when charging of the rechargeable battery 31 is required. The first embodiment is different from the conventional electrically-heated clothes in that the power supply module 3 is designed to be detachable, and the electronic components 21 are received in the passage unit 111 so that they are not easily removed or displaced due to an external force. Thus, when this embodiment is dirty, the rechargeable battery 31 is first removed from the receiving space 121, after which the fabric 1 is put into a washing machine for cleaning. In other implementation of this embodiment, the rechargeable battery 31 may be connected fixedly and electrically to the electronic module 2, and the power supply module 3 may be other common form of power supply, and is not limited to what is disclosed herein.

A fixing hole 131 is formed between the pouch body 12 and the fabric body 11, and communicates with the path 13. The fabric 1 further includes a fixing ring 14 connected to the outer surface 113 of the fabric body 11 spaced apart from the pouch body 12, and an adjustable strap 15 extending through the fixing hole 131, the path 13 and the fixing ring 14 and extending around the outer surface 113 of the fabric body 11. The adjustable strap 15 is adjustable through overlapping strap ends thereof having hook and loop fasteners, and is adjusted to conform to the user's body and to abut closely against the user's waist, so that the position of the fixing hole 131 is close to the user's waist and the position of the pouch body 12 is fixed. Through this, the rechargeable battery 31 received in the receiving space 121 can be prevented from rocking caused by a swinging movement of the user during walking. It should be noted herein that the fixing ring 14, the adjustable strap 15, the fixing hole 131 and the pouch body 12 may be dispensed herewith. These components are only provided to facilitate carrying of the rechargeable battery 31, and are not limited to what is disclosed herein.

Figure 5:
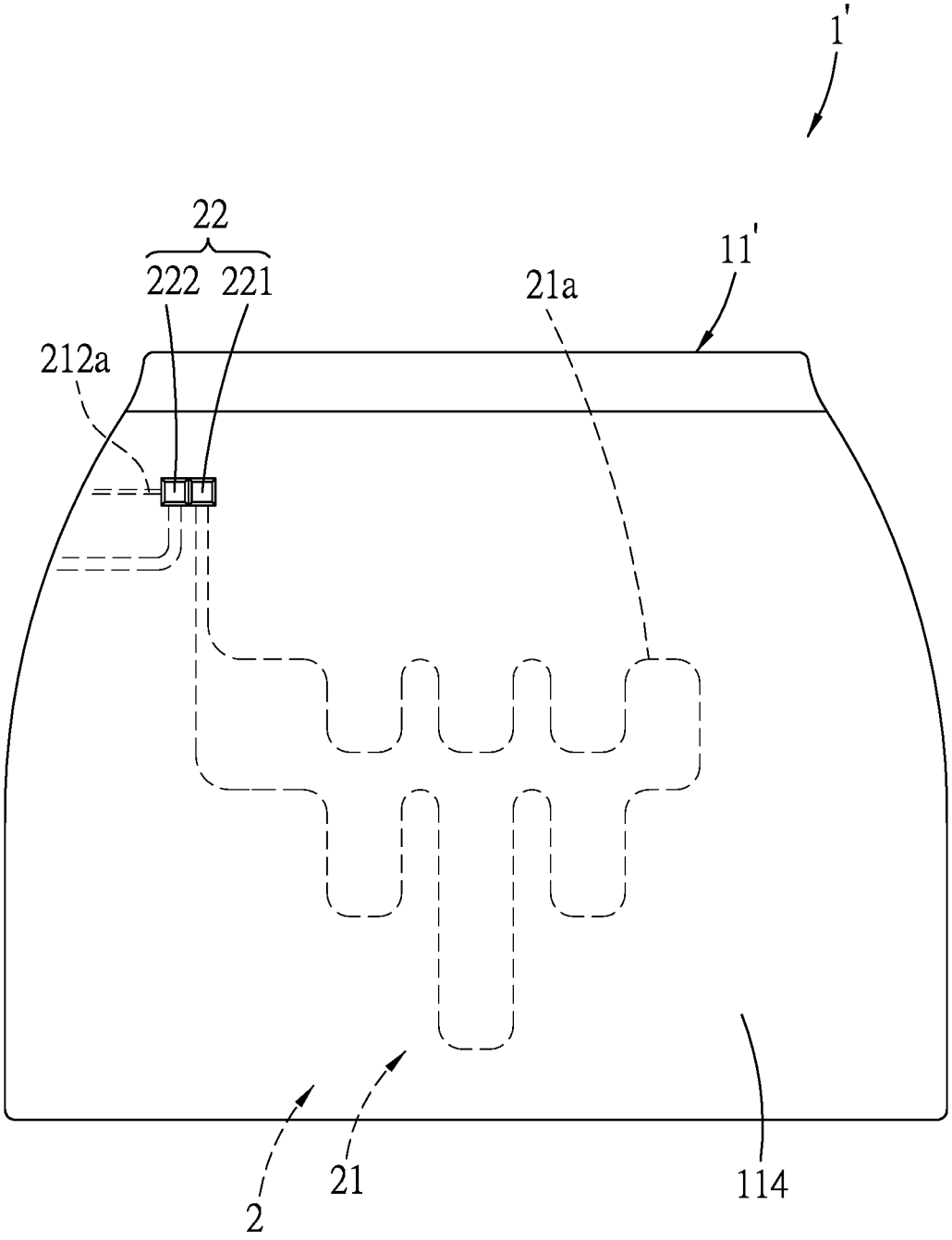
FIG. 5 is a transparent schematic view of a fabric device according to the second embodiment of the present disclosure.
Figure 6:
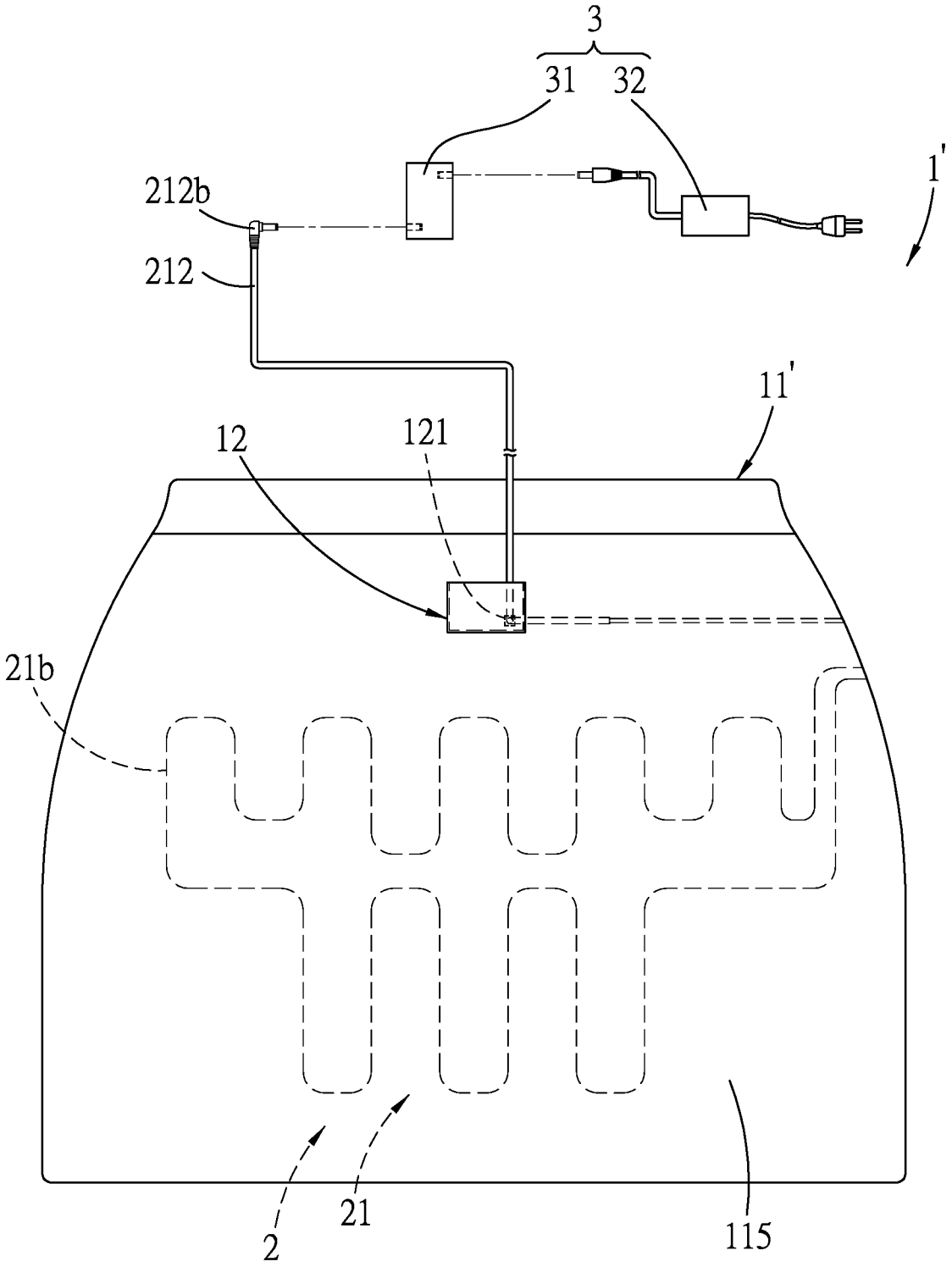
FIG. 6 is another transparent schematic view of the second embodiment.

Referring to FIGS. 5 and 6, the second embodiment of the fabric device of this disclosure is shown to be generally identical to the first embodiment. However, in this embodiment, the fabric 1' is made into a girdle, and the fabric body 11' has a first or front portion 114 for covering a front side of the user's waist, a second or rear portion 115 for covering a rear side of the user's waist, and two breathable net portions (not shown) respectively covering portions that are proximate to outer sides of the user's thighs to increase the wearing comfort. The switch module 22 can further be used to control the magnitude of electric power flowing through the electric heating wires 21 so as to control the magnitude of heat generated by the electric heating wires 21. The electric heating wires 21 of the electronic module 2 are divided into a plurality of groups which include a first electric heating wire group (21*a*) located on the front portion 114 of the fabric body 11', and a second electric heating wire group (21*b*) located on the rear portion 115 of the fabric body 11'.

In this embodiment, the switch module 22 includes a first switch element 221 electrically connected between the first electric heating wire group (21*a*) and the power supply module 3, and a second switch element 222 electrically connected between the second electric heating wire group (21*b*) and the power supply module 3. Specifically, the first and second switch elements 221, 222 are electrically connected to the power supply module 3 through the conductive wire 212. Each of the first and second switch elements 221, 222 is operable to establish electrical connection between the power supply module 3 and a respective one of the first and second electric heating wire groups (21*a*, 21*b*) and to control the magnitude of electric power flowing through each electric heating wire group (21*a*, 21*b*) so as to control the magnitude of heat generated by each electric heating wire group (21*a*, 21*b*).

It should be noted herein that although the groups of the electric heating wires 21 include two electric heating wire groups (21*a*, 21*b*) and the switch module includes two switch elements 221, 222 in this embodiment, in other implementations, the groups of the electric heating wires 21 may include more than three electric heating wire groups and the number of the switch elements may correspond to that of the electric heating wire groups.

In this embodiment, each of the first and second switch elements 221, 222 of is configured as a push button, and the magnitude of electric power of each of the first and second electric heating wire groups (21*a*, 21*b*) is divided into three temperature levels: high, medium and low temperature levels. Taking for example the first switch element 221, if the first switch element 221 is pressed for a long time, electrical connection between the first electric heating wire group (21*a*) and the power supply module 3 is established so that the first electric heating wire group (21*a*) generates heat. If the first switch element 221 is pressed for a short time, the temperature level of the first electric heating wire group (21*a*) is shifted from one of the temperature levels to the next. If the first switch element 221 is repeatedly pressed for a short time, the temperature level of the first electric heating wire group (21*a*) is repeatedly shifted among the three temperature levels. If the first switch element 221 is again pressed for a long time, electrical connection between the electric heating wire group (21*a*) and the power supply module 3 is disconnected or cut.

Further, in this embodiment, each of the first and second switch elements 221, 222 can vibrate when pressed to inform the user about the current temperature level of the first or second electric heating wire group (21*a*, 21*b*). Taking again for example the first switch element 221, if the first electric heating wire group (21*a*) is shifted to the high temperature level, the first switch element 221 will vibrate thrice; if the first electric heating wire group (21*a*) is shifted to the medium temperature level, the first switch element 221 will vibrate twice; and, if the first electric heating wire group (21*a*) is shifted to the low temperature level, the first switch element 221 will vibrate once. Additionally, each of the first and second switch elements 221, 222 can also emit light to inform the user about the current temperature level of the first or second electric heating wire group (21*a*, 21*b*). Taking for example the first switch element 221, if the first electric heating wire group (21*a*) is shifted to the high temperature level, the first switch element 221 will emit red light for a long time; if the first electric heating wire group (21*a*) is shifted to the medium temperature level, the first switch element 221 will emit white light for a long time; and, if the first electric heating wire group (21*a*) is shifted to the low temperature level, the first switch element 221 will emit blue light for a long time. The fabric device of this embodiment also has an automatic power off function. If the first or second electric heating wire group (21*a*, 21*b*) is continuously heated for about 30 minutes, the power will automatically shut off, so that safety is enhanced.

Figure 7:
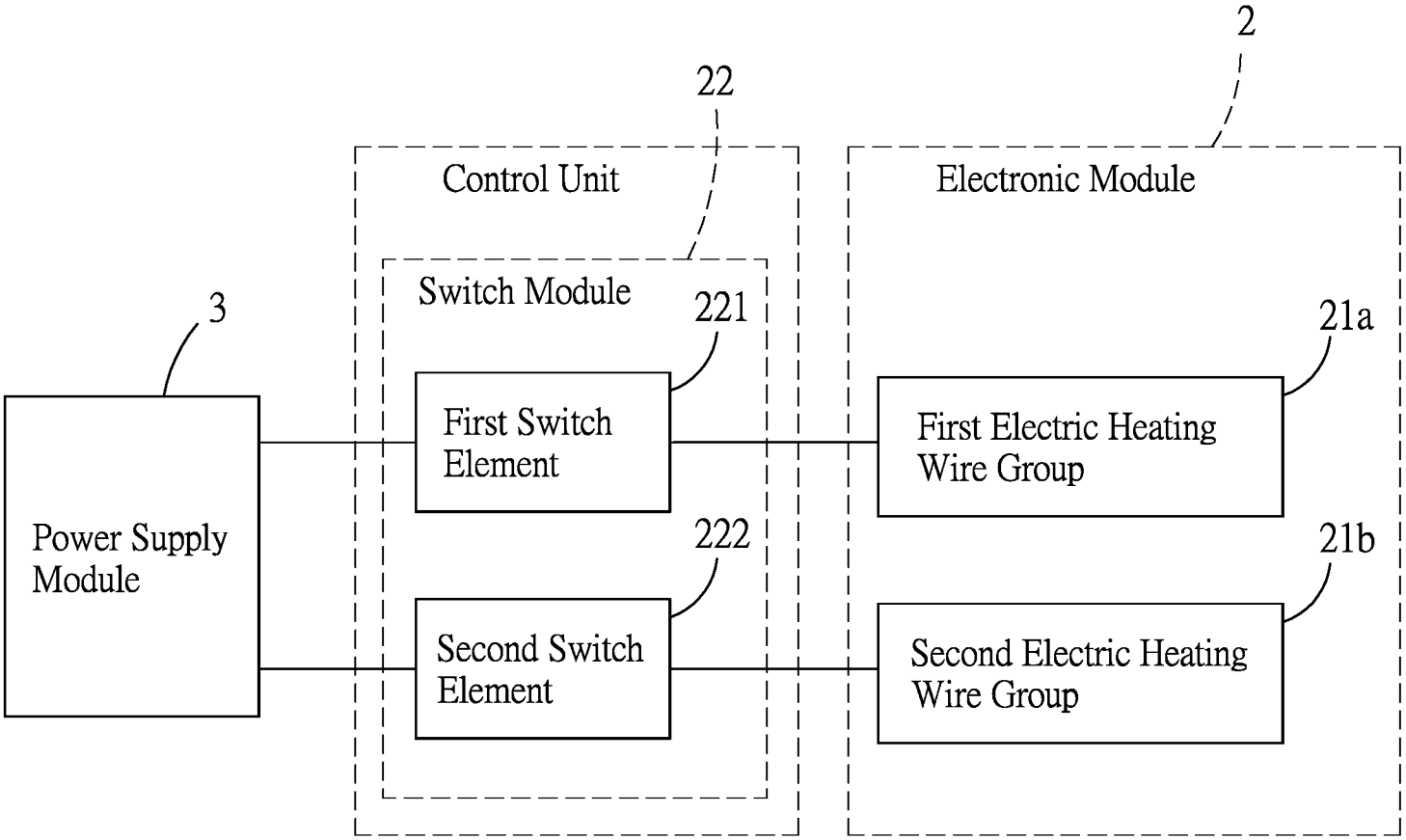
FIG. 7 is a block diagram of the second embodiment, illustrating electrical connections among a power supply module, a control unit and an electronic module.
Figure 8:
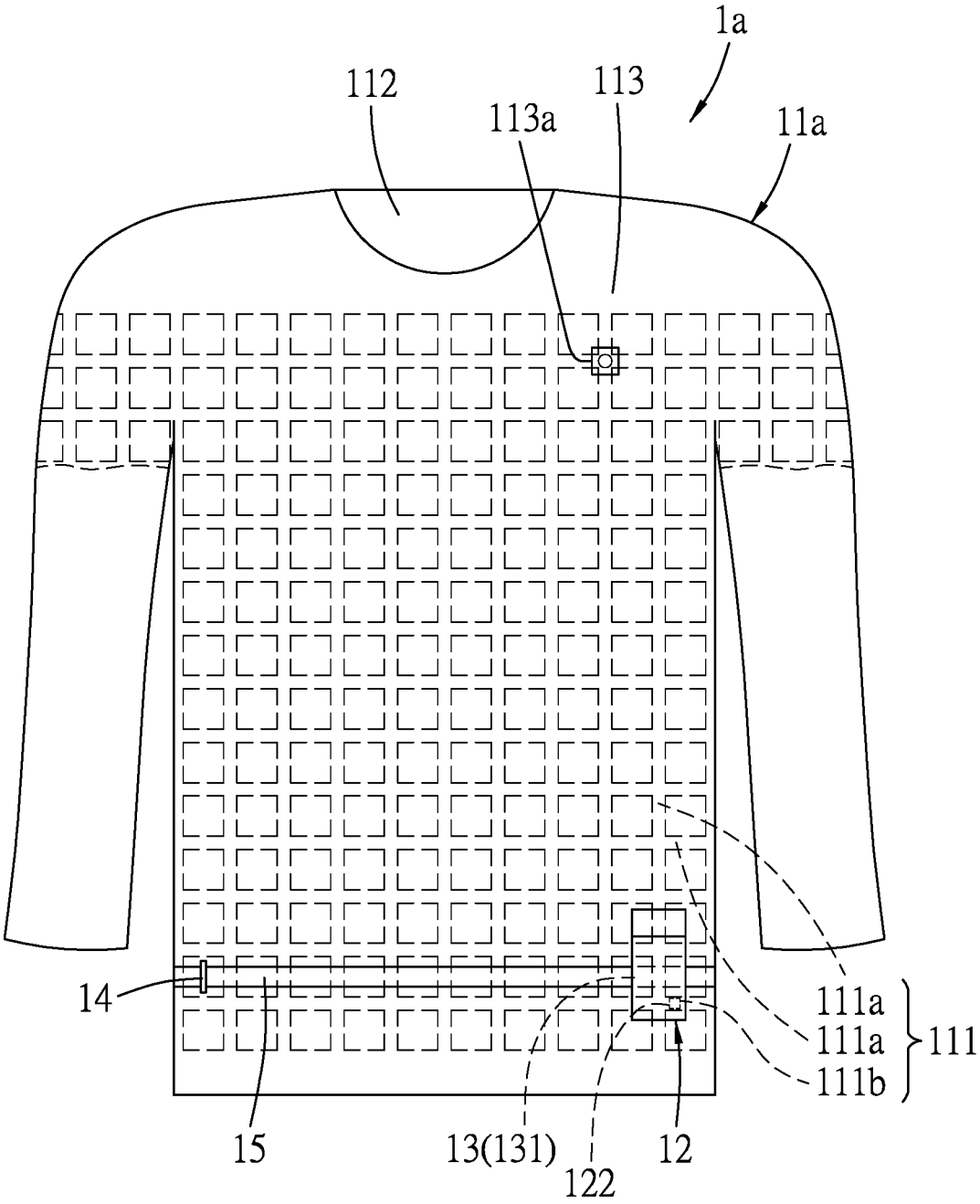
FIG. 8 is a schematic view of a fabric device according to the third embodiment of the present disclosure.
Figure 9:
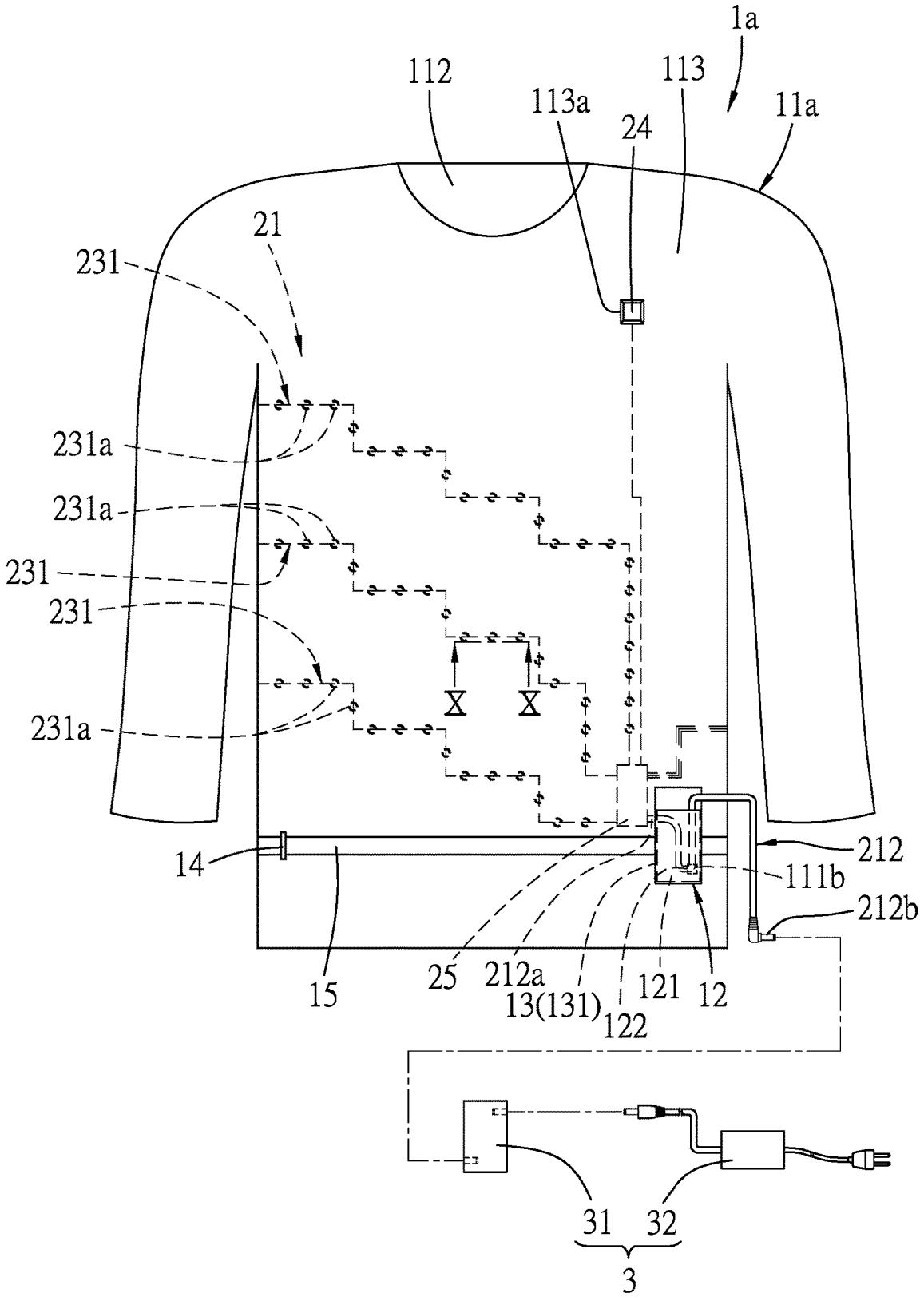
FIG. 9 is another schematic view of the third embodiment.
Figure 10:
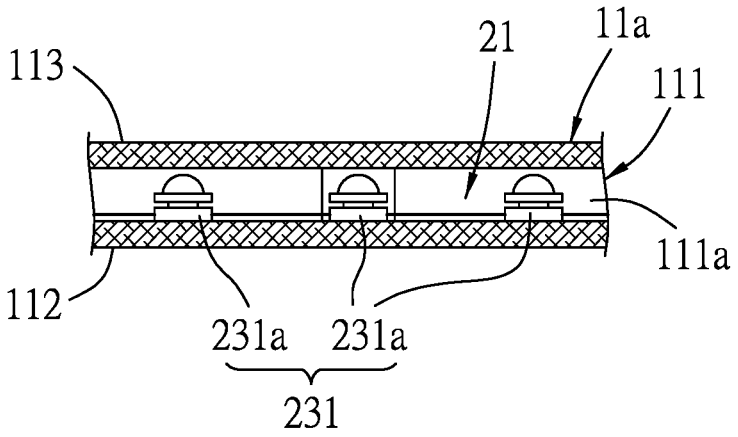
FIG. 10 is a sectional view taken along line X-X of FIG. 9.

FIG. 7 is a block diagram of the second embodiment, illustrating electrical connections among the power supply module 3, the control unit and the electronic module 2.

Referring to FIGS. 8 to 11, the third embodiment of the fabric device of this disclosure is shown to be generally identical to the first embodiment. However, in this embodiment, the fabric (1*a*) is made into a light emitting clothes for safety or entertainment purposes, the second surface 113 of the fabric body (11*a*) is light permeable, and each electronic component 21 is a string of light emitting elements 231. The electronic module 2 includes a plurality of the strings of light emitting elements 231. Each string of light emitting elements 231 is composed of a plurality of light emitting diodes (231*a*) connected in series with each other. The electronic module 2 is operable to switch among different light emitting modes.

In this embodiment, the control unit includes an input unit 24 and a control module 25. The input unit 24 is mounted in the mounting hole (113*a*) and is exposed from the second surface 113 of the fabric body (11*a*). The control module 25 is electrically connected to the power supply module 3 through the conductive wire 212, the input unit 24 and the strings of light emitting elements 231. The first connecting end (212*a*) of the conductive wire 212 is electrically connected to the control module 25.

The input unit 24 is operable to generate an input signal which is associated with a desired one of the light emitting modes. The control module 25 is configured to receive electric power from the power supply module 3 and the input signal from the input unit 24, is configured to generate a plurality of control signals based on the received electric power and the received input signal, and is configured to transmit the control signals to the strings of light emitting elements 231, respectively. As such, the strings of light emitting elements 231 can emit light according to the control signals so as to exhibit the desired one of the light emitting modes.

In this embodiment, the input unit 24 and the control module 25 are provided to facilitate the user to control the light emitting mode of the light emitting elements 231 according to his/her requirement. In other implementation of this embodiment, the input unit 24 and the control module 25 may be dispensed herewith, and are not limited to what is disclosed herein. It should be noted herein that different arrangements of the strings of light emitting elements 231 can generate different visual effects.

Figure 12:
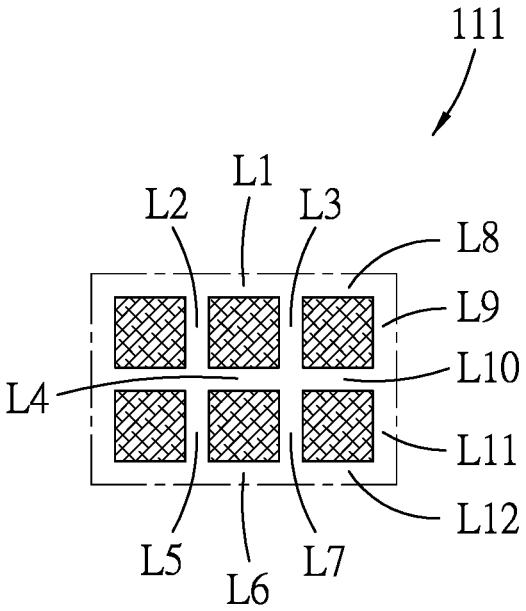
FIG. 12 is an enlarged fragmentary sectional view of a passage unit of the third embodiment.

FIG. 12 is an enlarged fragmentary sectional view of the passage unit 111. The passage unit 111 is divided into a first section (L1), a second section (L2), a third section (L3), a fourth section (L4), a fifth section (L5), a sixth section (L6) and a seventh section (L7). These seven sections (L1~L7) cooperate to form the number "8". If seven strings of light emitting elements 231 are respectively arranged on the seven sections (L1~L7), and with the control unit 24 and the input unit 25 controlling the light emission of each string of light emitting elements 231, different numbers may be displayed by the emitted light. For example, if only the strings of light emitting elements 231 at the third and seventh sections (L3, L7) are operated to emit light, the number "1" is displayed; and, if the strings of light emitting elements 231 at the first, third, fourth, sixth and seventh sections (L1, L3, L4, L6, L7) are operated to emit light, the number "3" is displayed. If only to display the number "8" and not other numbers, only one string of light emitting elements 231 may be arranged on the seven sections (L1~L7).

The passage unit 111 may be further divided into an eighth section (L8), a ninth section (L9), a tenth section (L10), an eleventh section (L11) and a twelfth section (L12). If twelve strings of light emitting elements 231 are respectively arranged on the twelve sections (L1~L12), the strings of light emitting elements 231 can generate more visual effects.

For example, in the beginning, only the strings of light emitting elements 231 at the first, third, fourth, sixth and seventh sections (L1, L3, L4, L6, L7) are operated to emit light, the number "3" is displayed in the middle of the figure. Then, when the strings of light emitting elements 231 at the first, third, fourth, sixth and seventh sections (L1, L3, L4, L6, L7) are turned off, while the strings of light emitting elements 231 at the eighth to twelfth sections (L8~L12) are operated to emit light, the number "3" is displayed at the right side of the figure. An effect of moving the number "3" from the middle to the right side is achieved. In the same way, the number "3" can also be moved from the middle to the left side. Such an arrangement can permit the strings of light emitting elements 231 to produce an effect similar to a horse race lamp. In sum, by arranging the strings of light emitting elements 231 in different ways, different desired effects can be achieved.

Figure 13:
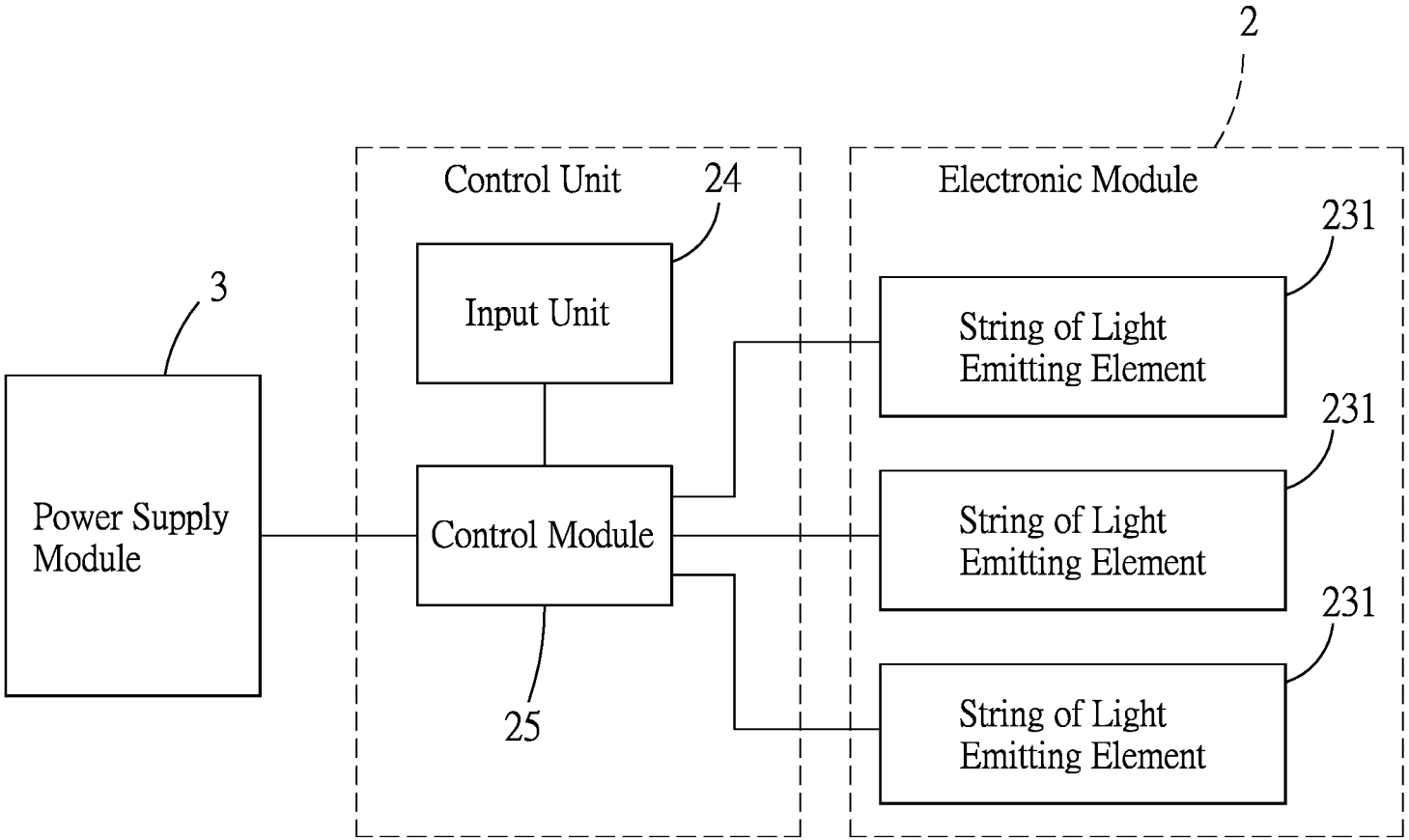
FIG. 13 is a block diagram of the third embodiment, illustrating electrical connections among a power supply module, a control unit and an electronic module.
Figure 14:
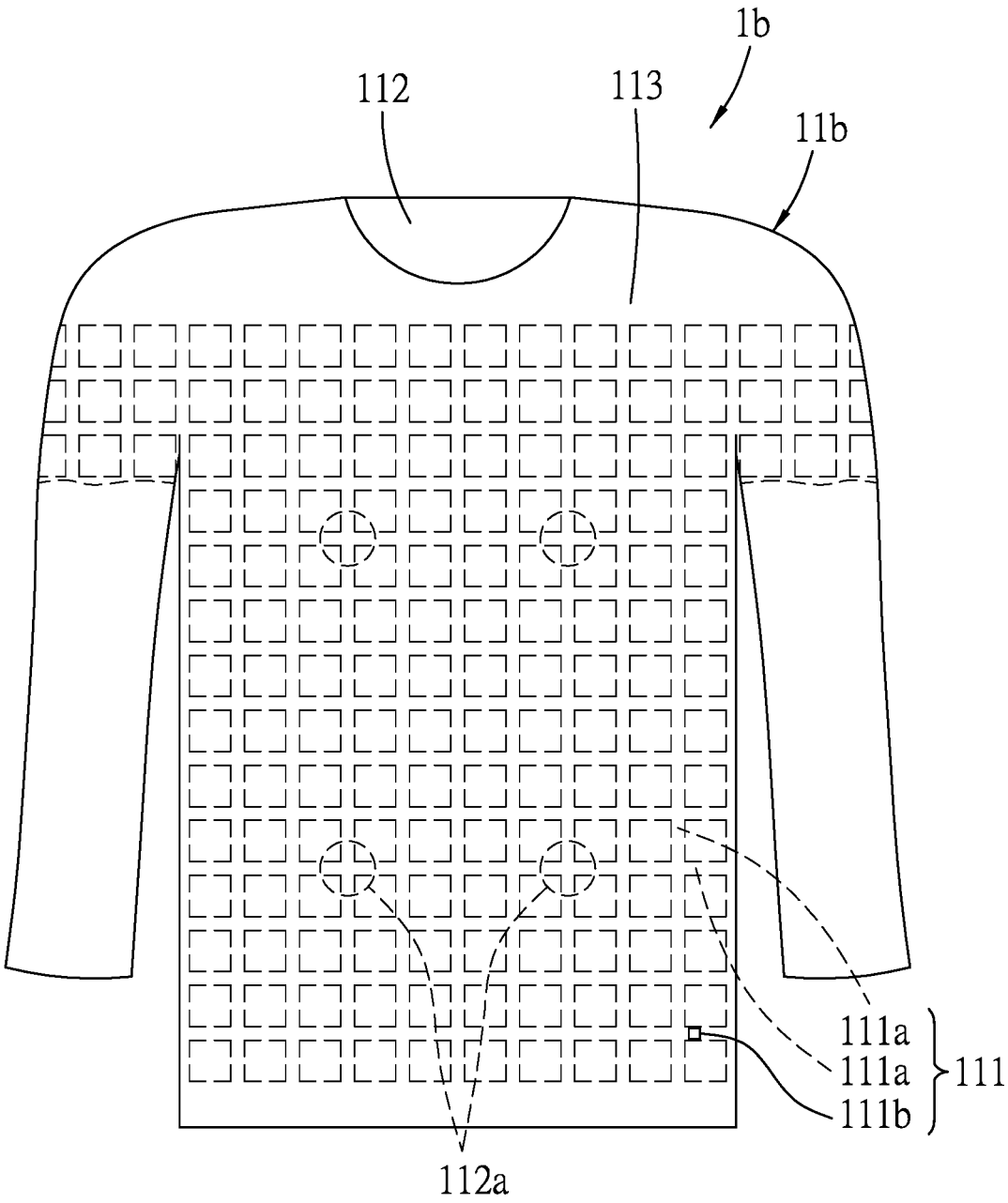
FIG. 14 is a schematic view of a fabric device according to the fourth embodiment of the present disclosure.

FIG. 13 is a block diagram of the third embodiment, illustrating electrical connections among the power supply module 3, the control unit and the electronic module 2.

Referring to FIGS. 14 to 17, the fourth embodiment of the fabric device of this disclosure is shown to be generally identical to the first embodiment. However, in this embodiment, the electronic components 21 are configured to electrically connect with a medical device (not shown), and each electronic component 21 is a conductive wire having a first end extending out of the second surface 113 of the fabric body (11*b*) of the fabric (1*b*) for connection with the medical device, and a second end opposite to the first end. The electronic module 2 further includes a plurality of conductive pads (112*a*) formed on the first or inner surface 112 of the fabric body (11*b*). Four conductive pads (112*a*) and four electronic components or conductive wires 21 are exemplified in this embodiment. Each conductive pad (112*a*) is electrically connected to the second end of a respective one of the conductive wires 21. However, in other implementation of this embodiment, the electronic module 2 may have two, three or more than five conductive pads (112*a*) and the number of the conductive wires 21 may correspond to that of the conductive pads (112*a*), and is not limited to what is disclosed herein.

Figure 15:
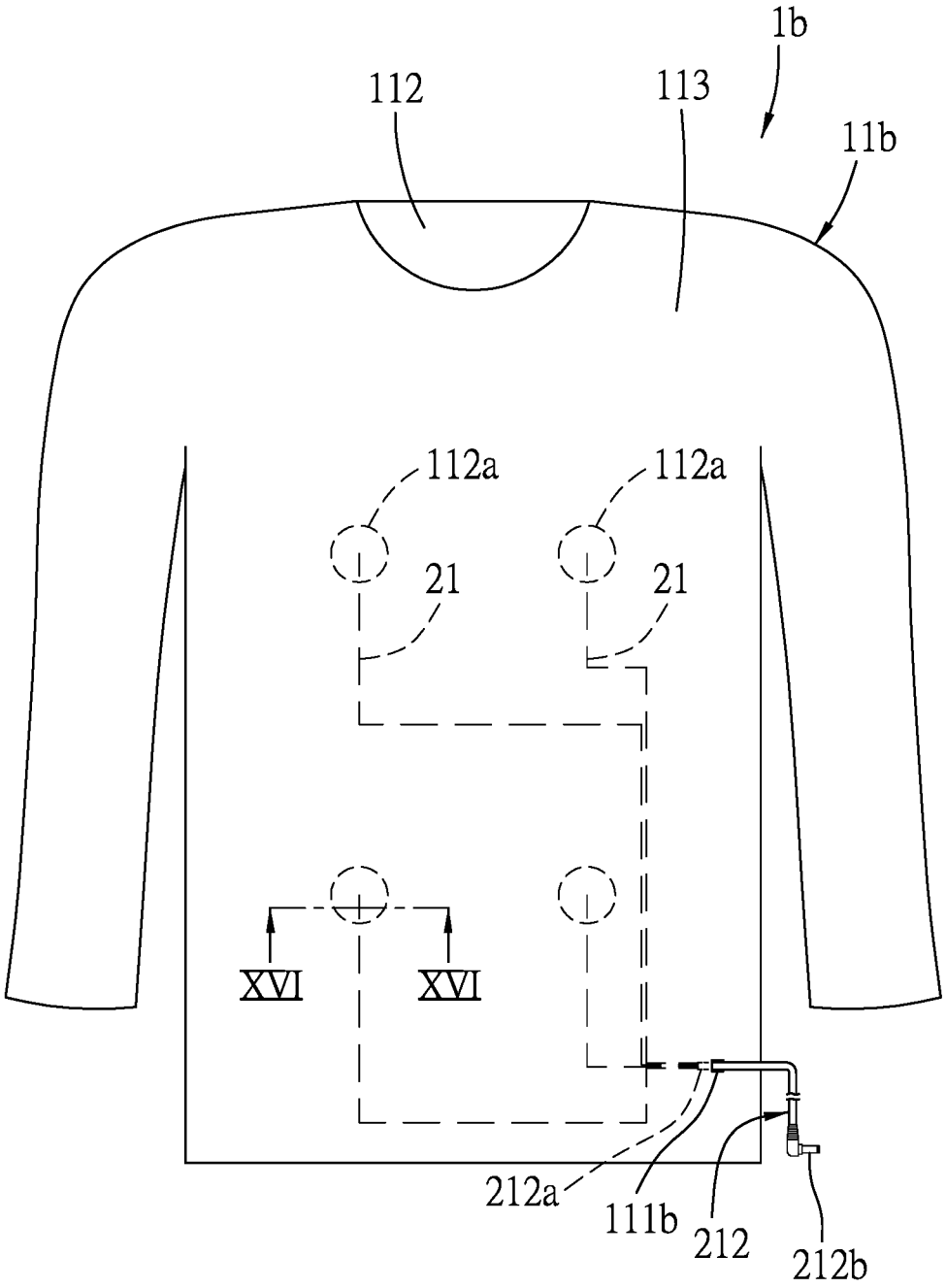
FIG. 15 is another schematic view of the fourth embodiment.
Figure 16:
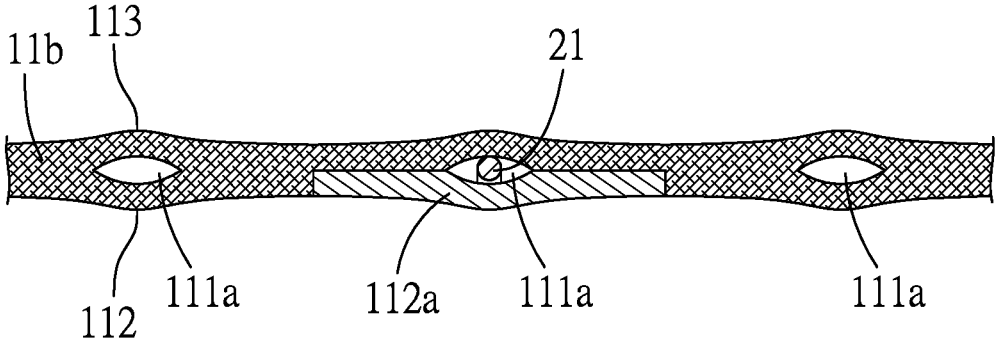
FIG. 16 is a sectional view taken along line XVI-XVI of FIG. 15.

The medical device exemplified in this embodiment is a physiological signal measuring device for monitoring the condition of a human body. The conductive wires 21 are electrically connected to the physiological signal measuring device through the conductive wire 212. The first connecting end (212*a*) of the conductive wire 212 is electrically connected to the second ends of the conductive wires 21, while the second connecting end (212*b*) thereof is electrically connected to the physiological signal measuring device. When the inner surface 112 of the fabric body (11*b*) contacts the human body with the four conductive pads (112*a*) being located on different parts of the human body, as shown in FIG. 15, each conductive pad (112*a*) serves as a sensing pad and receives an electrophysiological signal from the human body. The received electrophysiological signal from each conductive pad (112*a*) is then transmitted out through the second end of the corresponding conductive wire 21 and the second connecting end (212*b*) of the conductive wire 212 to the physiological signal measuring device.

In other implementation of this embodiment, the medical device may be an electrotherapy device for generating a potential difference among the conductive pads (112*a*). When the inner surface 112 of the fabric body (11*a*) contacts the human body, the second ends of the electronic components 21 can respectively receive electrical signals from the electrotherapy device, and the received electrical signals can be transmitted to the user's body through the conductive wires 21 and the conductive pads (112*a*) to perform electrotherapy on the user's body.

In this embodiment, only one conductive wire 212 is exemplified. In other implementation of this embodiment, more than two conductive wires 212 may be provided, and is not limited to what is disclosed herein.

Figure 4:
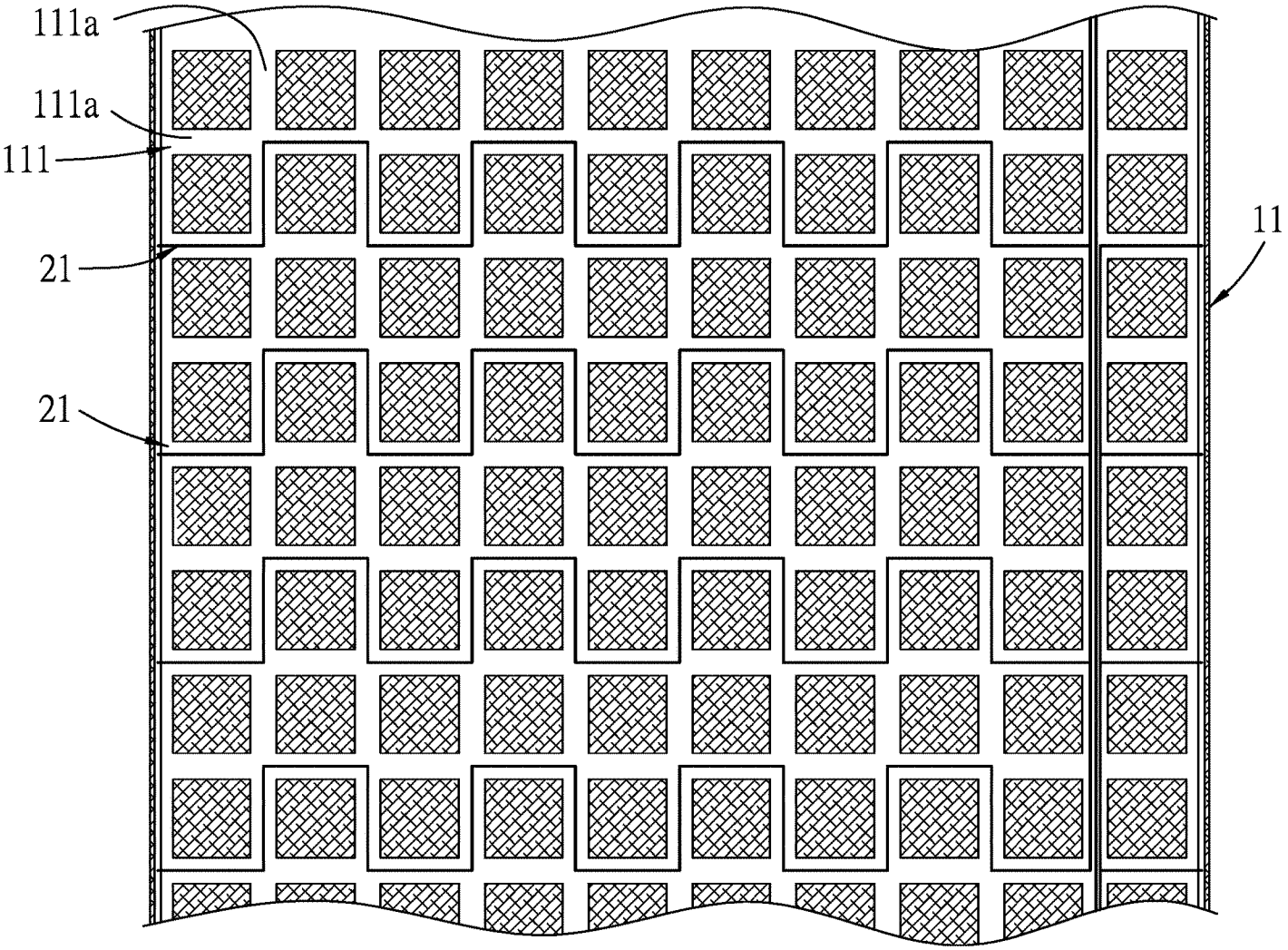
FIG. 4 is an enlarged fragmentary sectional view of the first embodiment.
Figure 11:
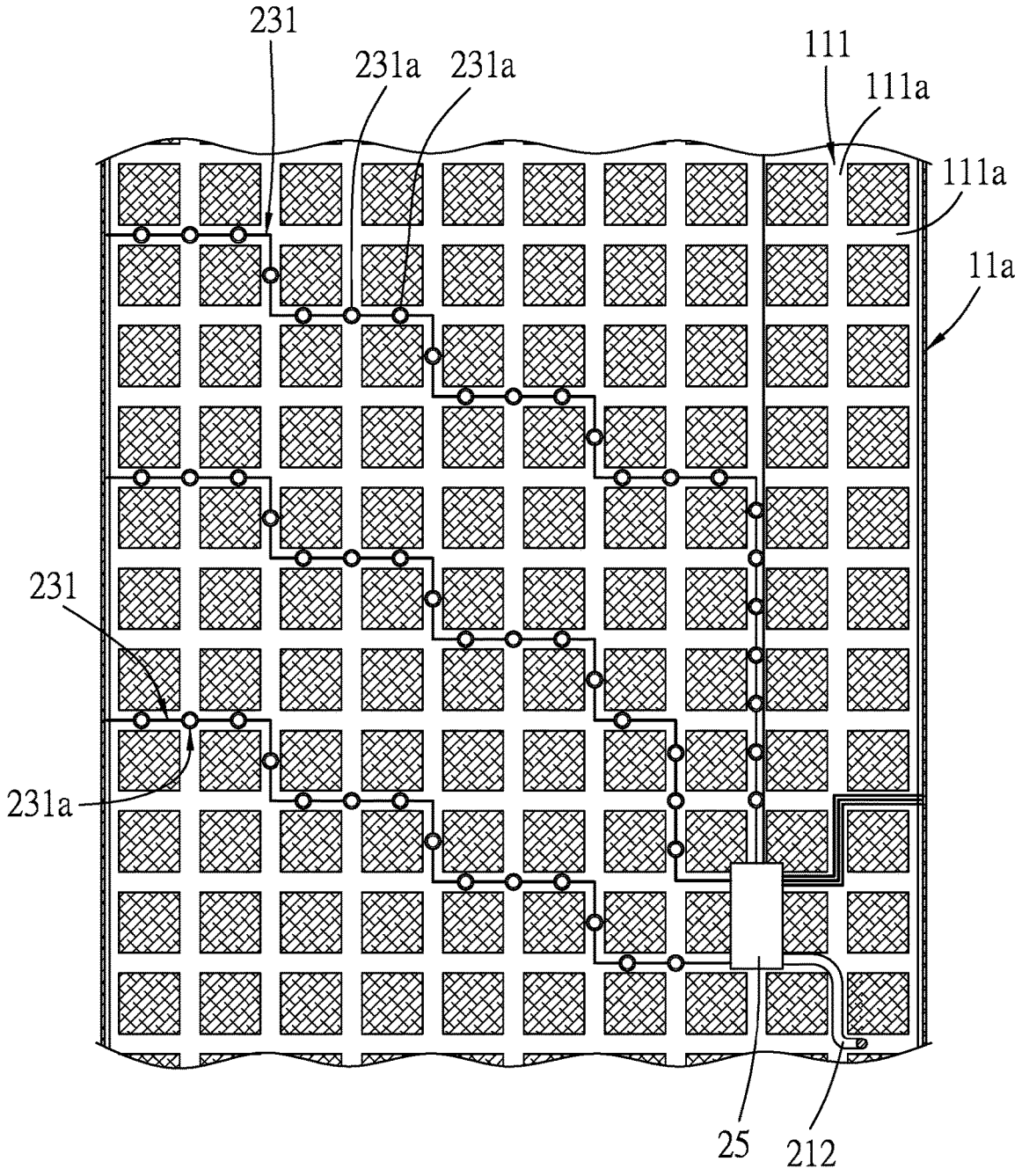
FIG. 11 is an enlarged fragmentary sectional view of the third embodiment.
Figure 17:
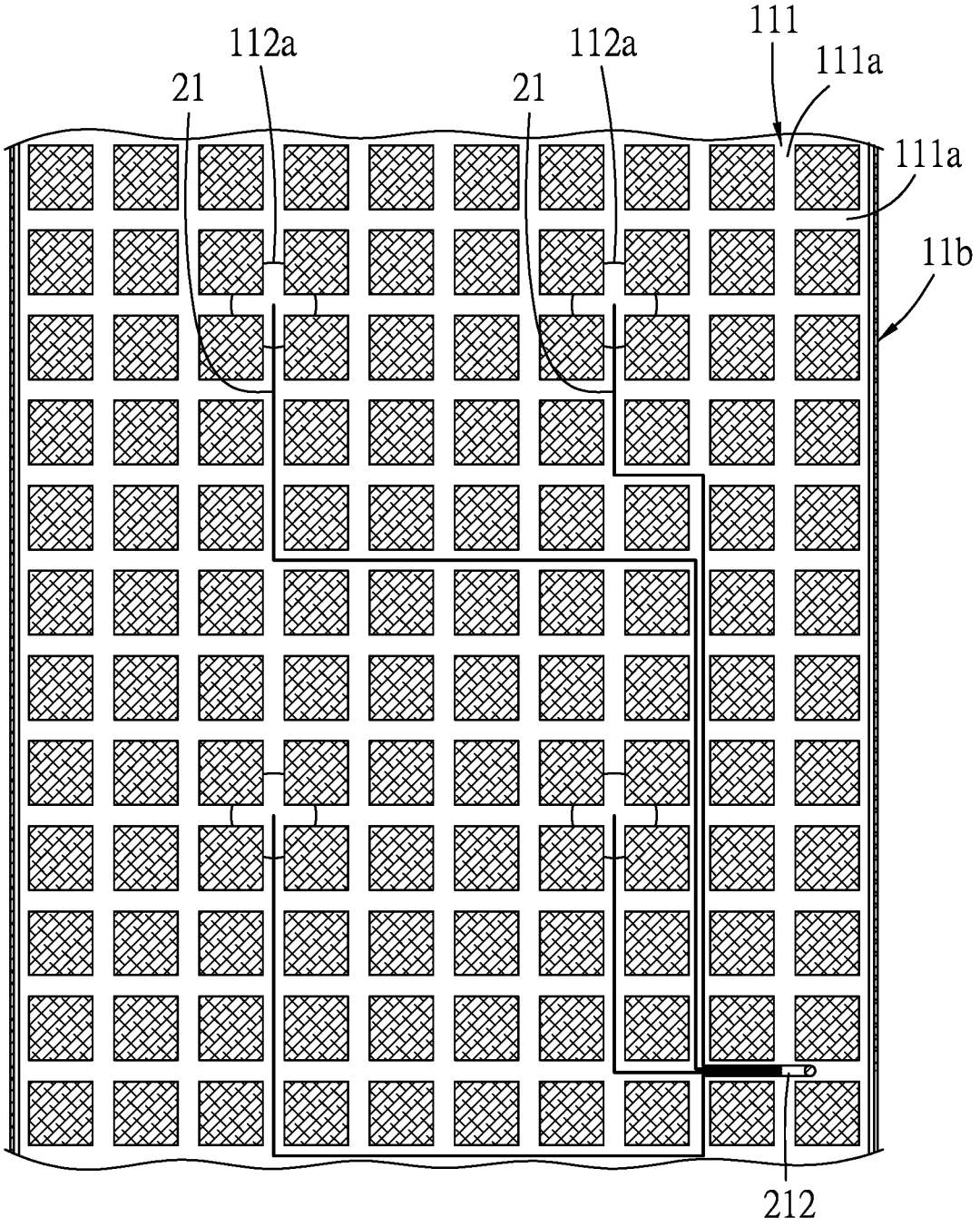
FIG. 17 is an enlarged fragmentary sectional view of the fourth embodiment.
Figure 18:
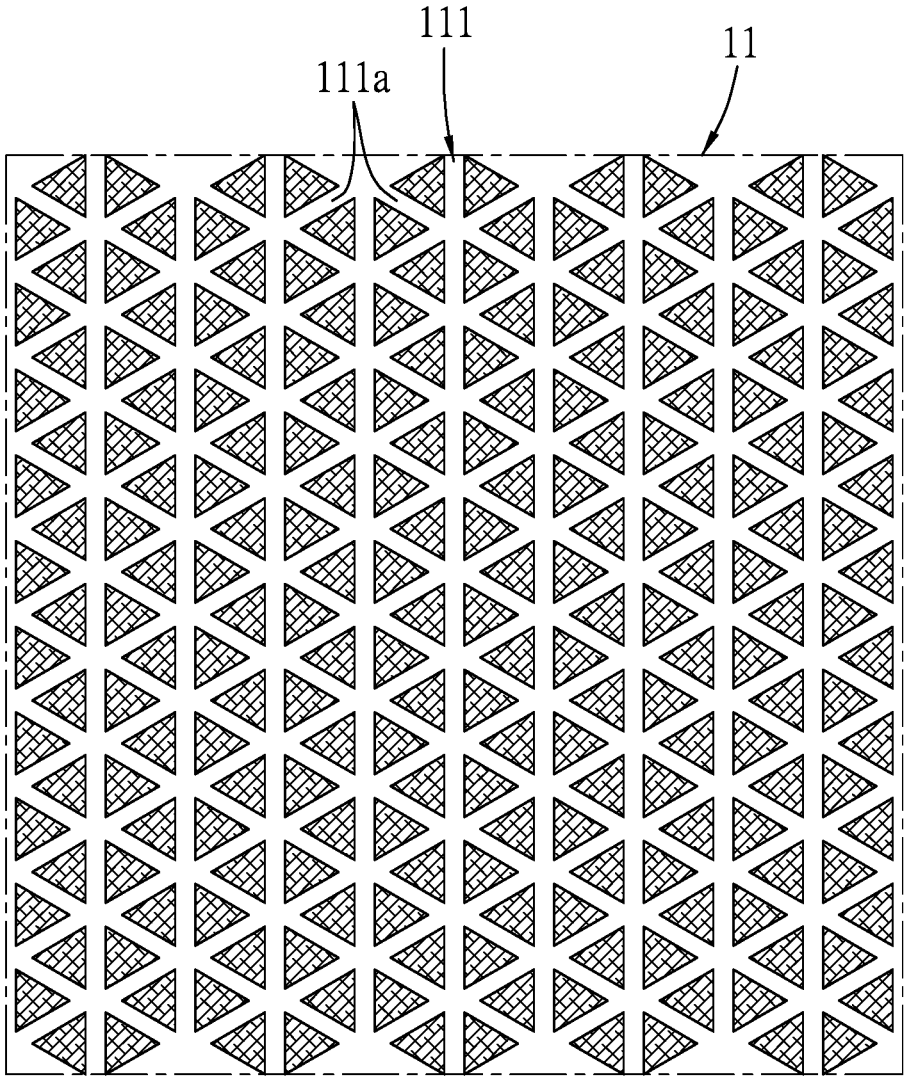
FIG. 18 is an enlarged fragmentary sectional view, illustrating an alternative form of the passage unit.
Figure 19:
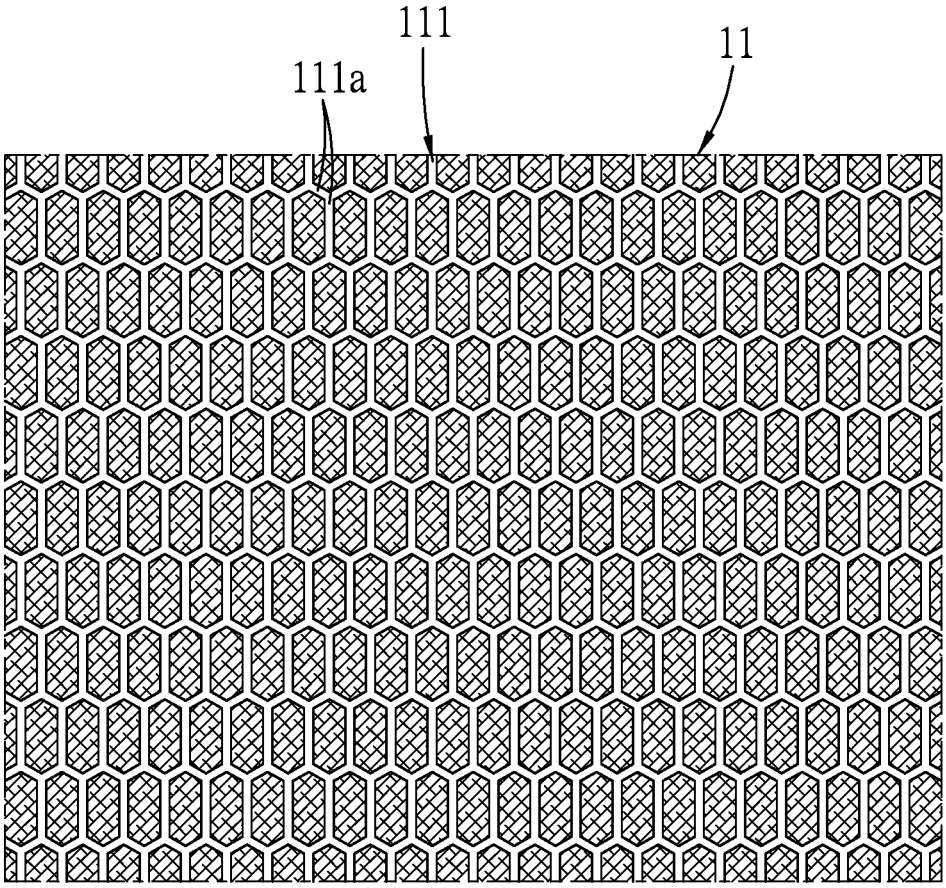
FIG. 19 is an enlarged fragmentary sectional view, illustrating another alternative form of the passage unit.

With reference to FIGS. 4, 11 and 17, in the foregoing embodiments, the passages (111*a*) of the passage unit 111 intersect each other to form a plurality of squares. However, in other embodiments, the passages (111*a*) may intersect each other to form a plurality of triangles, as shown in FIG. 18, or a plurality of hexagons, as shown in FIG. 19, or even a plurality of circles (not shown). As long as the passages (111*a*) intersect each other, any shape formed thereby is acceptable, and is not limited to what is disclosed herein.

In the foregoing embodiments, the fabric body (11, 11', 11*a*, 11*b*) is formed as one piece. In other alternative embodiments, the fabric body (11, 11', 11*a*, 11*b*) may be formed by two layers of cloth, and is not limited thereto.

In sum, with the electronic components 21 of the fabric device of this disclosure disposed in the passage unit 111 of the fabric body (11, 11', 11*a*, 11*b*), they are not easily displaced or detached from the fabric (1, 1', 1*a*, 1*b*) due to an external force, so that the electronic components 21 can be fixedly connected to the fabric (1, 1', 1*a*, 1*b*). Further, the electronic components 21 can be arranged in different ways in the passage unit 111 to conform to the different requirements. Moreover, with the conductive pads (112*a*) located at specific positions on the inner surface 112 of the fabric body (11*b*) and with the electronic components 21 extending into the passage unit 111 of the fabric body (11*b*), when it is required to use the medical device, there is no need to connect one by one the electronic components 21 to the specific positions of the human body. It is only necessary to wear the fabric (1*b*) with the pre-arranged conductive pads (112*a*), and then the signals can be transmitted to the medical device or applied potential difference to the human body through the conductive pads (112*a*) and the electronic components 21. Therefore, the object of this disclosure can be realized.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fabric device comprising:

a fabric including a fabric body configured to contact or to be worn on an object, said fabric body having a first surface configured to contact the object, and a second surface opposite to said first surface, said fabric body being internally formed with a passage unit, said passage unit having a plurality of passages arranged in a grid structure and intersecting and communicating with each other; and an electronic module disposed in said fabric body and including a plurality of electronic components, in the form of strips, extending into said passage unit, and a plurality of conductive pads formed on said first surface of said fabric body;

wherein the object is a human body, wherein each of said electronic components is a conductive wire, and has a first end extending out of said second surface of said fabric body and a second end opposite to said first end; and wherein each of said conductive pads is electrically connected to said second end of a corresponding one of said electronic components.

2. The fabric device as claimed in claim 1, further comprising a control unit disposed in said fabric body and electrically connected to said electronic module, said control unit being configured to receive an electric power from a power supply module so as to control operation of said electronic module.

3. The fabric device as claimed in claim 2, further comprising said power supply module, said power supply module being electrically connected to said control unit.

4. The fabric device as claimed in claim 3, wherein said power supply module is a rechargeable battery module.

5. The fabric device as claimed in claim 4, wherein said fabric further includes a pouch body connected to said second surface of said fabric body and defining a receiving space for receiving said power supply module.

6. The fabric device as claimed in claim 1, wherein, when said first surface of said fabric body contacts the human body, each of said conductive pads serves as a sensing pad and receives an electrophysiological signal from the human body, and the received electrophysiological signal is transmitted out through said second end of the corresponding one of said electronic components.

7. The fabric device as claimed in claim 1, wherein, when said first surface of said fabric body contacts the human body and said second ends of said electronic components respectively receive electrical signals, the received electrical signals are transmitted to the human body through said electronic components and said conductive pads.

* * * * *